US007237754B2

(12) United States Patent
Sparkowski

(10) Patent No.: US 7,237,754 B2
(45) Date of Patent: Jul. 3, 2007

(54) POLE ASSEMBLY FOR SUPPORTING A SIGN

(75) Inventor: Robert P. Sparkowski, Schaumburg, IL (US)

(73) Assignee: Chicago Display Marketing Corporation, River Grove, IL (US)

( * ) Notice: Subject to any disclaimer, the term of this patent is extended or adjusted under 35 U.S.C. 154(b) by 274 days.

(21) Appl. No.: 10/909,520

(22) Filed: Aug. 2, 2004

(65) Prior Publication Data

US 2006/0022099 A1 Feb. 2, 2006

(51) Int. Cl.
*A47B 96/06* (2006.01)

(52) U.S. Cl. ..... 248/219.1; 248/230.8; 40/607.14; 40/607.01

(58) Field of Classification Search ..... 248/218.4, 248/219.2, 219.1, 219.3, 229.17, 228.8, 230.8, 248/231.85, 300; 40/607.14, 607.01, 611.12, 40/602–604; 160/378; 116/173, 174; 403/400, 403/388

See application file for complete search history.

(56) References Cited

U.S. PATENT DOCUMENTS 1,697,025 A 1/1929 Searle
3,034,242 A 5/1962 Gold
3,347,505 A * 10/1967 Menser ..... 248/68.1
3,370,369 A 2/1968 Look
3,564,743 A 2/1971 Gilmoure
3,593,450 A 7/1971 Mollet, III et al.
3,675,356 A 7/1972 Gilmoure
3,726,035 A 4/1973 Bower
4,095,360 A * 6/1978 Dinan et al. ..... 40/603
4,341,029 A 7/1982 Heard
4,730,803 A 3/1988 Hillstrom
4,890,403 A 1/1990 Dinan
5,428,913 A 7/1995 Hillstrom
5,694,733 A * 12/1997 Gallemore, II ..... 52/736.2
5,732,915 A 3/1998 Heard
6,192,611 B1 * 2/2001 Molla ..... 40/604
6,493,973 B1 * 12/2002 Nelson ..... 40/607.12
6,618,973 B2 9/2003 Nelson

FOREIGN PATENT DOCUMENTS

DE 19951432 A1 * 5/2001

* cited by examiner

*Primary Examiner*—Gwendolyn Baxter
(74) *Attorney, Agent, or Firm*—Michael Best & Friedrich LLP

(57) ABSTRACT

An assembly for supporting a sign and adapted to engage a pole includes a pair of mounting plates disposed contiguously with a pole. Each mounting plate comprises a second aperture through which a band is inserted to connect each mounting plate to the pole. A crossmember is fed through a first aperture to support a sign or banner. The crossmember is receptive to an alignment device to prevent unwanted lateral movement. Additionally, the crossmember is receptive to two stops on either of its two ends. Each end stop prevents the sign or banner from sliding off the crossmember under adverse conditions.

20 Claims, 5 Drawing Sheets

POLE ASSEMBLY FOR SUPPORTING A SIGN

BACKGROUND

The present disclosure is directed to a pole assembly for supporting a sign and, more particularly, to an assembly adaptable to engage various pole configurations utilizing at least one pair of mounting plates, at least one band and a crossmember to support a sign.

Conventional pole assemblies for supporting a sign adapt to poles and other vertical posts to support a placard or other type of banner.

However, pole assemblies have suffered from various drawbacks. One drawback of conventional assemblies is that they are unable to adapt to various pole sizes and configurations due to the type of mounting mechanisms employed. For instance, some mounting mechanisms are well adapted for use on a square pole, but are ill-suited for circular or diamond pole configurations. Other conventional assemblies use complex parts that increase costs and the required skills necessary to assemble and operate.

As a result, there exists a need in the art for a pole assembly for supporting a sign that is easily adaptable to any second pole shapes and sizes. Moreover, a need exists for a pole assembly that is inexpensive and simple to manufacture and assemble.

BRIEF DESCRIPTION OF THE DRAWINGS

Certain embodiments are shown in the drawings. However, it is understood that the present disclosure is not limited to the arrangements and instrumentalities shown in the attached drawings, wherein.

DETAILED DESCRIPTION

Briefly, in one embodiment, a pole assembly for supporting a sign includes a pair of mounting plates where each mounting plate comprises a first aperture and a second aperture. A band is used to connect each of the mounting plates to the pole at a specified height. A crossmember is fed through both first apertures to support a sign. To provide greater support for the assembly, the band may also be fed through the second apertures.

Figure 1:
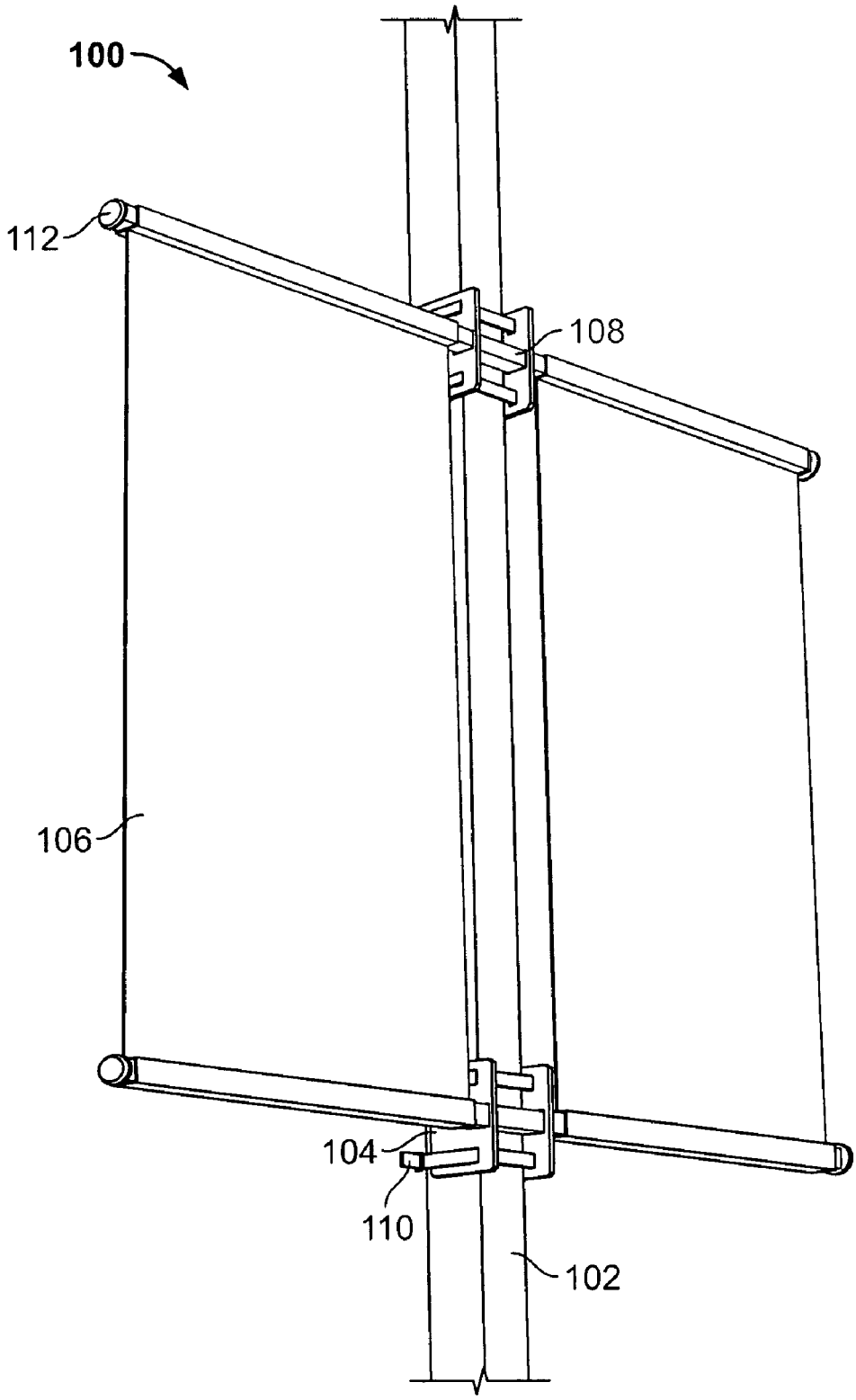
FIG. 1 is a perspective view of a pole assembly for supporting a sign.

Referring to FIG. 1, one embodiment of a pole assembly 100 includes two pairs of mounting plates 104 connected to a pole 102. Each pair of mounting plates 104 is connected to the pole 102 by a pair of bands 110 that wraps around the pole 102 and at least a portion of each mounting plate 104. Each mounting plate 104 is preferably connected to a separate location of the pole 102. For instance, when the pole 102 is substantially square, each mounting plate 104 of a pair of mounting plates 104 may be disposed on opposing sides of the pole 102.

Preferably, the first pair of mounting plates 104 is connected at a first height while the second pair of mounting plates 104 is connected at a second height along the pole 102. A crossmember 108 engages each pair of mounting plates 104 to support one or more signs or banners 106. Each crossmember 108 may further include two removable stops 112 that prevent the banners 106 from sliding off the crossmembers 108 when exposed to high winds or other adverse conditions.

Figure 2B:
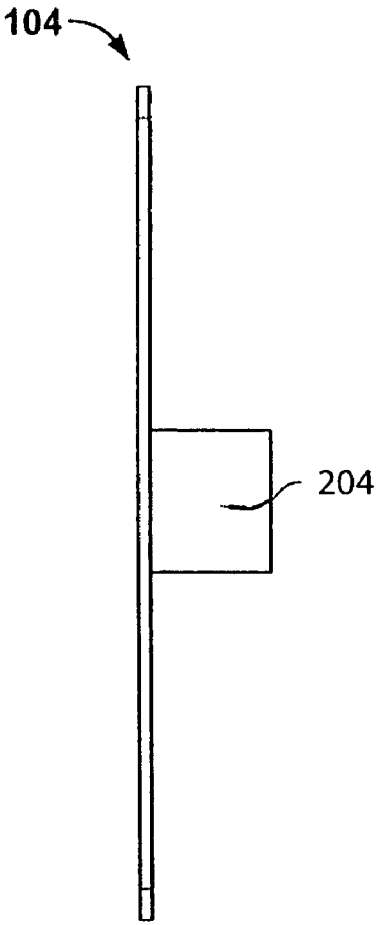
FIG. 2B is a side elevation view of the mounting plate of FIG. 2A illustrating a flange extending from the body of the mounting plate.
Figure 2A:
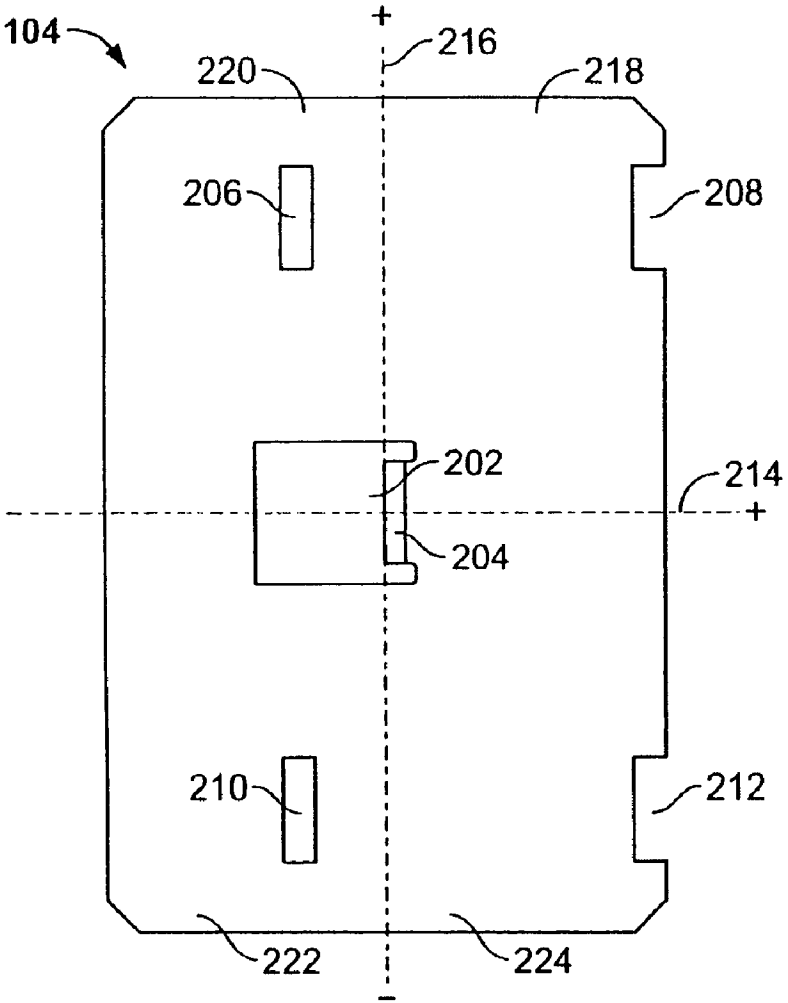
FIG. 2A is a front elevation view of a mounting plate for use in the pole assembly of FIG. 1.

Referring to FIGS. 2A and 2B, a mounting plate 104 is illustrated in greater detail. FIG. 2A is a front elevation view of the mounting plate 104 showing, among other things, reference lines superimposed upon the mounting plate 104. As illustrated, the lateral axis 214 and the longitudinal axis 216 divide the mounting plate 104 into four quadrants.

It will be recognized by those of ordinary skill in the art that the lateral axis 214 and longitudinal axis 216 respectively represent conventional "x" and "y" axes of a Cartesian coordinate system superimposed on the mounting plate 104. As a result, the first quadrant 218 is defined as the set of positive (+) lateral axis 214 values and positive (+) longitudinal axis 216 values. Similarly, the second quadrant 220 is defined by the set of negative (−) lateral axis 214 values and positive (+) longitudinal axis 216 values. The third quadrant 222 is defined by the set of negative (−) lateral axis 214 values and negative (−) longitudinal axis 216 values. Lastly, the fourth quadrant 224 is defined by the set of positive (+) lateral axis 214 values and negative (−) longitudinal axis 216 values.

FIG. 2A further illustrates a first aperture 202 formed within the body of the mounting plate 104 and located substantially along the intersection of the lateral axis 214 and the longitudinal axis 116. While the first aperture 202 can take the form of any shape capable of receiving a crossmember 108, FIG. 2A depicts the first aperture 202 as a parallelogram with one edge disposed along the longitudinal axis 216. In this embodiment, a flange 204 is situated along the longitudinal axis 216 and projects normal from the parallelogram-shaped first aperture 202. In other embodiments, the flange 204 may be angularly oriented with respect to the main body of the mounting plate 104.

The mounting plate 104 of FIG. 2A further includes a second aperture 206 formed in the second quadrant 220 and a third aperture 210 formed in the third quadrant 222. Laterally aligned with the second aperture 206 is a first notch 208 formed along a side of the mounting plate 104 in the first quadrant 218. Similarly, a second notch 212 is formed along a side of the mounting plate 104 in the fourth quadrant 224 such that its position is laterally aligned with the third aperture 210 and longitudinally opposed to the first notch 208. The second aperture 206, third aperture 210, first notch 208 and second notch 212 may take any shape capable of receiving a band 110.

The apertures and notches described above may be formed by a process utilizing a machine punch. However, it will be recognized by those of skill in the art that any process forming the apertures and notches as described above can be used alternatively. For instance, this disclosure anticipates the use of various molding techniques to form the apertures and notches in each mounting plate 104.

As used throughout this specification and claims, the term "aperture" shall be synonymous with the term "orifice" and both shall be used interchangeably herein. Similarly, as used throughout this specification and claims, the term "band" shall be synonymous with the term "clamp" and both shall be used interchangeably herein.

With respect to FIG. 2B, a side elevation view of the mounting plate 104 of FIG. 2A illustrates one embodiment of a pole assembly 100 depicting a substantially planar mounting plate 104. While the mounting plate 104 is depicted as a parallelogram, any conceivable geometric shape and dimension may be used so long as each plate 104 is properly sized to include at least a first aperture and properly support the assembly 100.

FIG. 2B further illustrates the flange 204 projecting angularly outward from the body of the mounting plate 104. As provided above, the flange 204 is generally located along an edge of the first aperture 202 near to the longitudinal axis 216. However, it is conceived that the flange 204 may be located anywhere on the body of the mounting plate 104. In one embodiment, the flange 204 is normal to the body of the mounting plate 104.

Figure 3:
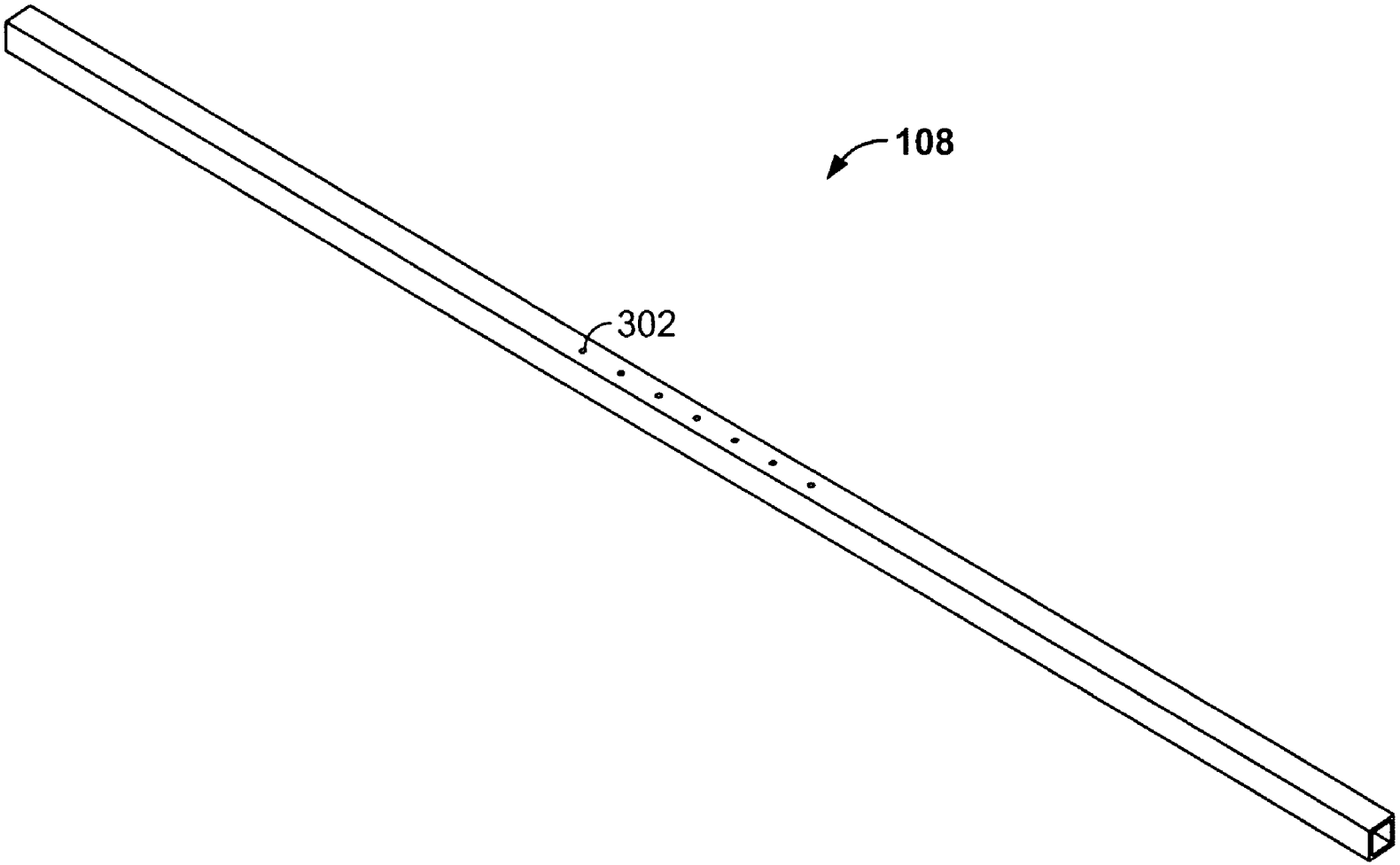
FIG. 3 is a perspective view of a crossmember for use in the pole assembly of FIG. 1.

Referencing now FIG. 3, a crossmember 108 is shown. In one embodiment, the crossmember 108 is defined by four walls configured as a rectangular tube. However, this disclosure contemplates a crossmember 108 of any geometric shape such as, but not limited to, a circular tube or a triangular tube. A plurality of holes 302 are formed in one wall of the crossmember 108. The plurality of holes 302 are generally spaced along the center of the crossmember 108 such that they span a distance longer than the width of the pole 102 to which the assembly 100 will be mounted.

Figure 6A:
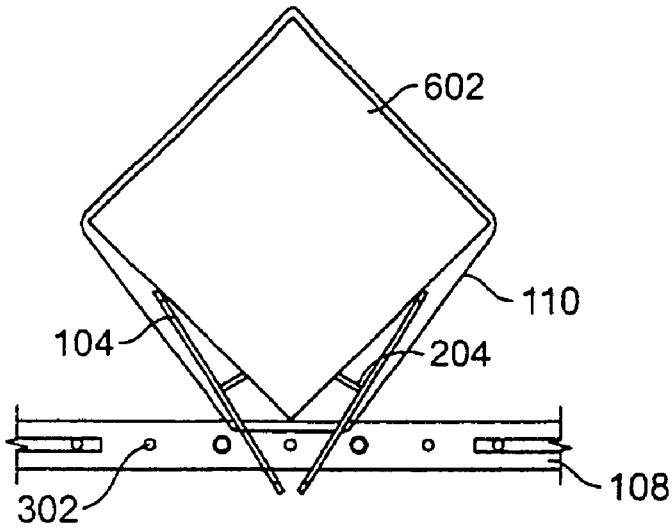
FIG. 6A is a section view of the pole assembly adapted to a diamond pole configuration.
Figure 6B:
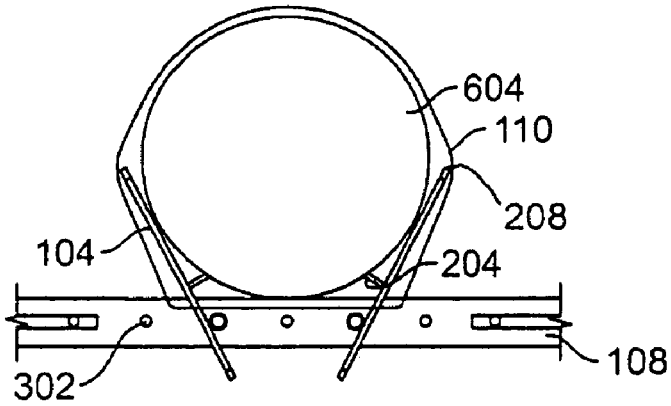
FIG. 6B is a section view of the pole assembly adapted to a circular pole configuration.

The function associated with the plurality of holes 302 formed in the wall of the crossmember 108 will be demonstrated with respect to FIGS. 6A-6B.

Figure 4:
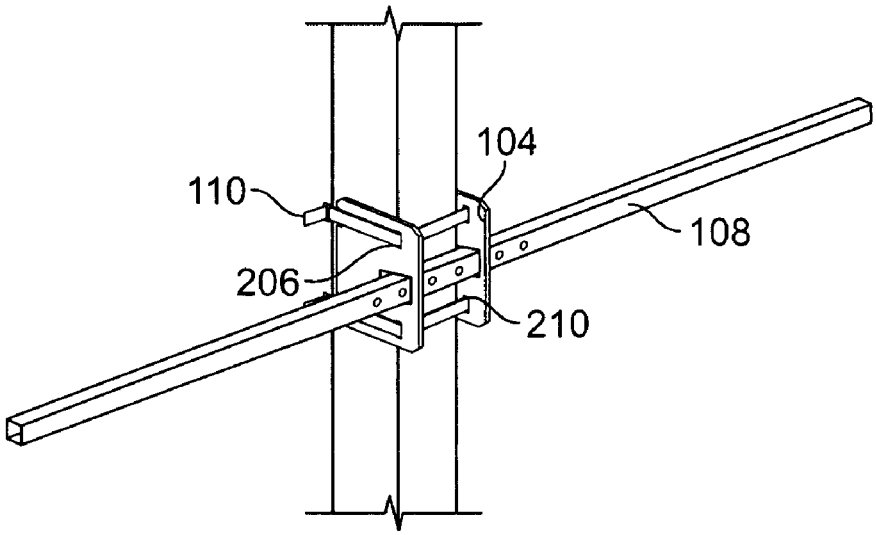
FIG. 4 is a detailed perspective view of a pair of mounting plates supporting the crossmember as assembled on a pole.

FIG. 4 illustrates a detailed view of a pair of mounting plates 104 disposed contiguously with a pole 102. In this embodiment, each mounting plate 104 is located at a separate location along the pole 102. A pair of bands 110 wraps around at least a portion of each mounting plate 104 and subsequently around the pole 102.

More specifically, a first band 110 wraps around at least a portion of each mounting plate 104, and in one embodiment, through each second aperture 206. Similarly, a second band 110 wraps around at least a portion of each mounting plate 104 and through each third aperture 210. By wrapping around the pole 102 and engaging either the second apertures 206 or the third apertures 210, the bands 110 provide greater stability to the assembly 100. Lastly, the crossmember 108 is inserted through each first aperture 202 to support a sign or banner 106.

While one embodiment requires the use of two bands 110 per pair of mounting plates 104, it is conceived that any number of bands 110 can be utilized to connect the mounting plates 104 to a pole 102. For example, in one embodiment a single band 110 can satisfactorily support and connect a pair of mounting plates 104 to a pole 102. In other embodiments, the number of apertures per mounting plate 104 may correspond to the number of bands 110 such that each band 110 engages each aperture for greater support of the assembly 100.

Figure 5:
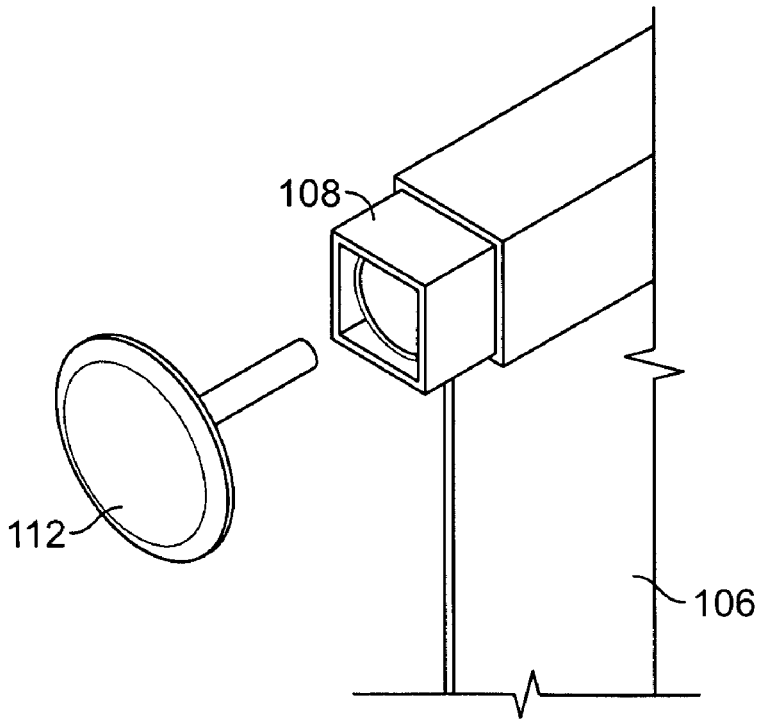
FIG. 5 is a detailed perspective view of the crossmember including a stop.

FIG. 5 illustrates a detailed view of an end of the crossmember 108. As shown, the end of the crossmember 108 is configured to receive a stop 112. In one embodiment, the stop 112 may be a screw with a large head. In other embodiments, the stop 112 may be any device that connects to the ends of the crossmember 108 and prevents the supported sign or banner 106 from sliding off the crossmember 108 in adverse conditions.

Figure 6C:
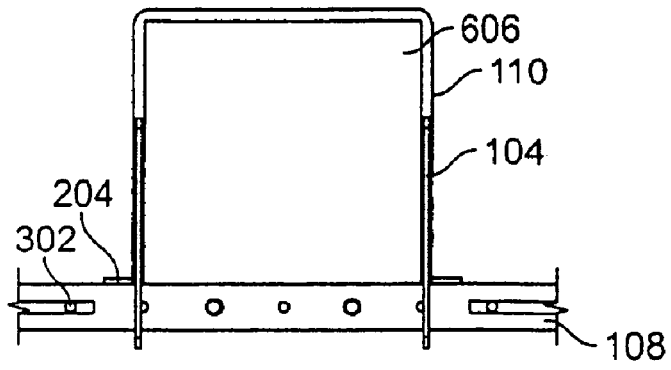
FIG. 6C is a section view of the pole assembly adapted to a square pole configuration.

FIGS. 6A-6C illustrate the flexible nature of the assembly 100 as it adapts to a variety of pole configurations. While the assembly 100 is capable of adapting to any pole shape, FIGS. 6A-6C illustrate the ability of the assembly 100 to adapt to a pole having a diamond configuration, a circular configuration and a square configuration, respectively. Each figure represents a sectional view of a pair of mounting plates 104, a first band 110 and a crossmember 108 of the assembly 100 adapted to a pole 102. For illustrative purposes, each figure illustrates the assembly 100 loosely connected to a pole 102 such that the first band 110 is clearly noticeable.

FIG. 6A shows a sectional view of a pole with a diamond configuration 602. Because the pole has a diamond configuration 602, the flanges 204 of each mounting plate 104 are pointed inward toward the pole 602. With the flanges 204 facing toward the pole 602, each mounting plate 104 braces the pole 602 at two separate locations thereby providing the assembly 100 additional support.

The first band 110 is utilized to hold the mounting plates 104 in position on the pole 602. In one embodiment, the first band 110 wraps around the pole 602 and the mounting plates 104. In a second embodiment, the first band 110 wraps around the pole 602 and through the second aperture 206 (not shown) of each mounting plate 104. Additionally, a crossmember 108 is supported by the first aperture 202 (not shown) of each mounting plate 104.

To secure the crossmember 108 in a desired position, an alignment device (not shown) such as a pin, peg, screw or other device may be placed in one or more of the plurality of holes 302. For example, in FIG. 6A, alignment devices may be placed in the holes 302 located on either side of the mounting plates 104 to prevent unwanted lateral motion of the crossmember 108. As illustrated, the plurality of holes 302 of the crossmember 108 are positioned vertically with respect to the pole 602. It is conceived that the crossmember 108 may be rotated such that the plurality of holes 302 are positioned normal to the pole 602. It is further envisioned that any mechanism capable of regulating the position of the crossmember 108 may be utilized as an alternate alignment device. For instance, an adhesive or band may substitute for a pin, peg or screw to keep the crossmember 108 within a desired relative position with respect to the pole 602.

FIG. 6B illustrates the assembly 100 of FIG. 6A adapted to a circular pole 604. Similar to the diamond configuration, this embodiment advantageously allows each mounting plate 104 to brace the pole 604 at two discrete locations by pointing the flanges 204 inward toward the pole 604.

FIG. 6B however, further illustrates the practicality of using a mounting plate 104 with at least one notch when adapting the assembly 100 to certain pole configurations. Wrapping a first band 110 through a first notch 208 in addition to wrapping the first band 110 around the pole 604 and through the second apertures 206 (not shown) reduces the amount of torque applied to each mounting plate 104.

The crossmember 108, disposed within each first aperture 202 (not shown), similarly contains a plurality of holes 302 receptive to an alignment device to prevent unwanted lateral movement.

FIG. 6C illustrates the assembly 100 adapted to a pole having a square configuration 606. In contrast to the diamond and circular configurations of FIGS. 6A-6B, the flanges 204 in FIG. 6C are directed outward, away from the pole 606. In this configuration, each mounting plate 104 is disposed contiguously against opposing sides of the pole 606 without the need for additional bracing by a flange 204.

Similar to FIGS. 6A-6B, the first band 110 wraps around the pole 606 and through the second apertures 206 (not shown). The crossmember 108 is fed through the first apertures 202 (not shown) and kept in a desired location by an alignment device inserted in one or more of a plurality of holes 302.

While FIGS. 6A-6C have been described in terms of using a first band 110 that engages each second aperture 206 and, in some embodiments, a first notch 208, a second band 110 can be utilized to provide additional support for the assembly 100. Similarly and as illustrated in FIGS. 1 and 4, by wrapping a second band 110 around the pole 102 and by further using the second band 110 to engage the third apertures 210, the mounting plates 104 are more firmly coupled to the pole 102. In some embodiments, the second band 110 additionally engages a second notch 212 to reduce the application of torque.

The components described above are preferably made of metal but may be composed of plastic or any composite such that the materials are capable of supporting a sign or banner 106 on a pole 102.

With reference to FIGS. 1-6, the method of mounting the assembly 100 to a pole 102 includes, preferably, placing a first pair of mounting plates 104 on the pole 102 at a workable height. If the pole 102 is substantially square, the flanges 204 face outward away from the pole 102. If the pole 102 is substantially circular or has a diamond configuration, the flanges 204 face toward the pole 102 to provide a second bracing point.

After the first pair of mounting plates 104 is placed on the pole 102, a pair of bands 110 are wrapped around the back portion of the pole 102. The first band 110 is fed through each second aperture 206 and the second band 110 is fed through each third aperture 210. For circular pole configurations, the first band 110 additionally engages the first notch 208 while the second band 110 engages the second notch 212 to prevent unwanted torque on the pair of mounting plates 104.

The pair of bands 110 are loosely tightened and a crossmember 108 is inserted through each first aperture 202. An alignment device is then inserted into one or more of the plurality of holes 302 of the crossmember 108. After the crossmember 108 is in place, the first pair of mounting plates 104 is relocated, if necessary, to its proper height and tightened.

The same process is repeated for a second pair of mounting plates 104. After both pairs of mounting plates 104 are in proper position, a sign or banner 106 can be attached to the crossmember 108. In one embodiment, the sign 106 has a top end and a bottom end. Each of the top and bottom ends have a pocket wherein the sign 106 can slide over the crossmembers 108. To prevent the sign 106 from sliding off the crossmembers 108, four stops 112 may be placed over the two ends of each crossmember 108.

As a result, the embodiments disclosed are not only inexpensive to manufacture, but are fully adaptable to all types of pole configurations. In addition, the present discussion has illustrated the ease through which one can assemble the pole assembly for supporting a sign or banner.

Furthermore, while the particular preferred embodiments have been shown and described, it will be obvious to those skilled in the art that changes and modifications may be made without departing from the teaching of the invention. The matter set forth in the foregoing description and accompanying drawings is offered by way of illustration only and not as limitation. The actual scope of the invention is intended to be defined in the following claims when viewed in their proper perspective based on the related art.

What is claimed is:

1. An assembly for supporting a sign and adapted to engage a pole comprising:

a pair of substantially planar mounting plates each adapted to be disposed contiguously with the pole at a separate location and including a first aperture, a second aperture, a third aperture and a flange extending from an edge of said first aperture and oriented angularly with respect to each mounting plate;

a crossmember, including a hole formed in a side wall and further including a first end and a second end, said crossmember being received in each first aperture such that each mounting plate supports said crossmember and said crossmember supports the sign;

a first band engaging each mounting plate through each of the second apertures;

a second band engaging each mounting plate through each of the third apertures such that said first and second bands connect said pair of mounting plates to the pole at a predetermined height;

an alignment device disposed within said hole to regulate a desired position of said crossmember;

a first stop connected to said first end of said crossmember; and a second stop connected to said second end of said crossmember.

2. The assembly of claim 1, further comprising:

a first notch defined along a side of each mounting plate and laterally aligned with said second aperture;

a second notch defined along a side of each mounting plate and laterally aligned with said third aperture;

wherein said first band further engages each of the first notches; and wherein said second band further engages each of the second notches such that said first and second bands further prevent the application of torque on said pair of mounting plates.

3. A method for supporting a sign on a pole, the method comprising the steps of:

mounting a pair of mounting plates to the pole at a predetermined height using a band, wherein each mounting plate includes a first aperture, a second aperture, a notch defined along a mounting plate side laterally aligned with the second aperture and the band is inserted through each second aperture and notch of the mounting plate pair;

inserting a crossmember through each first aperture; and mounting the sign on the crossmember.

4. The method of claim 3, wherein each mounting plate further includes a third aperture, and wherein the step of mounting the pair of mounting plates to the pole further includes the step of inserting a second band through each of the third apertures.

5. The method of claim 4, wherein each mounting plate further includes a second notch defined along a side of said mounting plate and laterally aligned with said third aperture, and wherein the step of mounting the pair of mounting plates to the pole further includes the step of inserting said second band through each second notch.

6. The method of claim 3, wherein each mounting plate further includes a flange extending from an edge of said first aperture and oriented angularly with respect to said mounting plate, and wherein the step of mounting the pair of mounting plates to the pole further includes positioning said flanges against the pole when the assembly is disposed contiguously with a substantially diamond pole configuration or a substantially circular pole configuration, and positioning said flanges outward with respect to the pole when the assembly is disposed contiguously with a substantially square pole configuration.

7. The method of claim 3, wherein the step of inserting the crossmember through each first aperture further includes the step of regulating a desired position of said crossmember by inserting at least one alignment device into a hole formed in a side wall of said crossmember.

8. The method of claim 3, wherein the step of mounting the sign on said crossmember further includes the steps of:

connecting a first stop on a first end of said crossmember; and connecting a second stop on a second end of said crossmember.

9. The method of claim 3 wherein the pair of mounting plates is a first pair, the crossmember is a first crossmember, the band is a first band and the method further comprises:

mounting a second pair of mounting plates to the pole at a second predetermined height using a second band, wherein each of the second mounting plate pair includes a first aperture and a second aperture and the band is inserted through each second aperture of the mounting plate pair;

inserting a second crossmember through each first aperture of the second mounting plate pair; and mounting the sign on the second crossmember.

10. An assembly for supporting a sign from a pole, the assembly comprising:

a pair of mounting plates, each mounting plate being adapted to be disposed contiguously with the pole at a separate location and including a first aperture, a second aperture and a notch defined along a mounting plate side laterally aligned with the second aperture;

a crossmember adapted to support the sign and to be received in each of the first apertures when the apertures are aligned such that the crossmember is supported by the mounting plates; and a band sized to extend through the second aperture and the notch of each mounting plate to secure the mounting plates to the pole.

11. The assembly of claim 10 wherein the band is a first band and the assembly further comprises:

a surface defining a third aperture in each mounting plate; and a second band sized to extend through the third aperture of each mounting plate to further secure the mounting plates to the pole.

12. The assembly of claim 11 wherein the notch in each mounting plate is a first notch and each mounting plate further includes:

a second notch defined along the mounting plate side laterally aligned with the third aperture; and the second band is sized to extend through both the second notch and third aperture of each mounting plate.

13. The assembly of claim 10 wherein each mounting plate further includes a flange oriented angularly with respect to each mounting plate.

14. The assembly of claim 13 wherein the flange extends from an edge of the first aperture.

15. The assembly of claim 10 further comprising:

a crossmember side wall having an alignment opening therein; and an alignment device disposed within the opening to position the crossmember with respect to the mounting plates.

16. The assembly of claim 10 further comprising:

a first stop connected to a first end of the crossmember; and a second stop connected to a second end of the crossmember, whereby each stop limits sign movement along the crossmember.

17. The assembly of claim 10 wherein each mounting plate is substantially planar.

18. The assembly of claim 10 wherein the pair of mounting plates is a first pair, the crossmember is a first crossmember, the band is a first band and the assembly further comprises:

a second pair of mounting plates, each of the second pair of mounting plates being adapted to be disposed contiguously with the pole at a separate location and including a first aperture and a second aperture;

a second crossmember adapted to secure the sign and to be received in each of the first apertures of the second pair of mounting plates when said mounting plates are aligned such that the crossmember is supported by the second pair of mounting plates; and a second band sized to extend through the second aperture and the notch of each of the second pair of mounting plates to secure said mounting plates to the pole such that the second crossmember is in position to secure the sign.

19. The assembly of claim 18 wherein:

each of the second pair of mounting plates further includes a notch defined along a side of each mounting plate laterally aligned with the second aperture; and the second band engages each notch.

20. The assembly of claim 18 wherein each of the second pair of mounting plates further includes a flange extending from an edge of the first aperture at an angle with respect to the mounting plate.

* * * * *